US005095672A

United States Patent [19]

Tanikawa

[11] Patent Number: 5,095,672

[45] Date of Patent: Mar. 17, 1992

[54] WINDOWSILL

[75] Inventor: Shinji Tanikawa, Marietta, Ga.

[73] Assignee: YKK Architectural Products Inc., Japan

[21] Appl. No.: 718,772

[22] Filed: Jun. 21, 1991

[30] Foreign Application Priority Data

Jun. 22, 1990 [JP] Japan ..... 2-65506

[51] Int. Cl.[5] ..... E06B 1/04

[52] U.S. Cl. ..... 52/215; 52/731; 52/397

[58] Field of Search ..... 52/213, 212, 214, 215, 52/397, 398, 731, 204, 775

[56] References Cited

U.S. PATENT DOCUMENTS

| | | | |
|---|---|---|---|
| 3,352,078 | 11/1967 | Neal | 52/731 |
| 3,357,681 | 12/1967 | Souza, Jr. | 52/731 |
| 3,815,311 | 5/1974 | Nisula et al. | 52/731 X |
| 3,858,377 | 1/1975 | Browne et al. | 52/73 X |
| 4,030,260 | 6/1977 | Sukolics et al. | 52/397 |

*Primary Examiner*—Richard E. Chilcot, Jr.
*Assistant Examiner*—Robert Canfield

[57] ABSTRACT

In a windowsill, when a sill attachment is pushed downwardly by the weight of a window pane, a pair of vertical plates of a sill member are pulled inwardly by engagement of downward hooks of a horizontal plate with upward hooks of vertical plates, thereby keeping the vertical plates from being deformed outwardly. Therefore, no gap would be formed between the vertical plates and side muntins, keeping rain water from penetrating into the windowsill.

1 Claim, 6 Drawing Sheets

WINDOWSILL

BACKGROUND OF THE INVENTION

1. Field of the Invention

This invention relates to a windowsill.

2. Description of the Related Art

One example of a known windowsill is shown in FIG. 12 of the accompanying drawings.

The windowsill comprises a U-shaped sill member 1, and a sill attachment 3 snapped over an open end of the sill member 1 and having a concave portion 2 for holding a panel.

With such a windowsill, side and central muntins 4 are fitted into the sill member 1, and then the sill attachment 3 is mounted on the sill member 1 so that the sill attachment 3 comes into contact with confronting surfaces of adjacent muntins 4, 4, thereby making a window have a good external appearance.

In this windowsill, a panel 5 is held in the concave portion 2 of the sill attachment 3, which would sometimes be pushed downwardly by the weight of the panel 5. Therefore a pair of vertical plates 6, 6 of the sill member 1 would be deformed outwardly, causing gaps to be made between the vertical plates 6 and the muntins 4, with the result that rain water would get into the windowsill through the gaps.

To overcome this inconvenience, it is conceivable to lay a block 7 in a space between the sill attachment 3 and the sill member 1 as indicated by phantom lines in FIG. 12 so that the panel 5 is supported by the sill member 1 via the block 7. In such a case, it is however very troublesome to place the block 7 in the sill member 1.

SUMMARY OF THE INVENTION

It is therefore an object of this invention to provide a windowsill which can solve the inconvenience experienced with the conventional windowsill.

According to this invention, there is provided a windowsill comprising: a U-shaped sill member, the sill member including a bottom plate and a pair of vertical plates, each of the vertical plates having at its upper end a muntin contacting portion and an upward hook aligned below the muntin contacting portion; and a sill attachment, the sill attachment including a horizontal plate, a concave portion for receiving a window pane, and a pair of vertical pieces at opposite ends of the horizontal plate. One of the vertical pieces has a downward hook, the other vertical piece having a downward hook and a guide piece aligned under the downward hook.

With this arrangement, the downward hooks are adapted to engage with the upward hooks respectively of the vertical plates of the sill member so that the opposite ends of the horizontal plate come into contact with the muntin contacting portions of the vertical plates so as to couple the sill member and the sill attachment.

DETAILED DESCRIPTION

Figure 3:
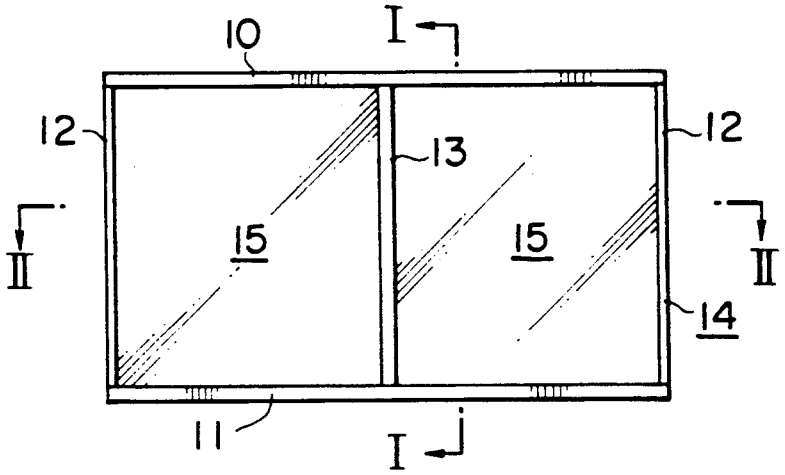
FIG. 3 is a schematic front view of the window of FIGS. 1 and 2.

As shown in FIG. 3, a window comprises a sash 14 which includes a head 10, a windowsill 11 (hereinafter called "the sill 11"), side muntins 12, 12 and a central muntin 13, and panels 15 such as glass panes received in the sash 14.

Figure 1:
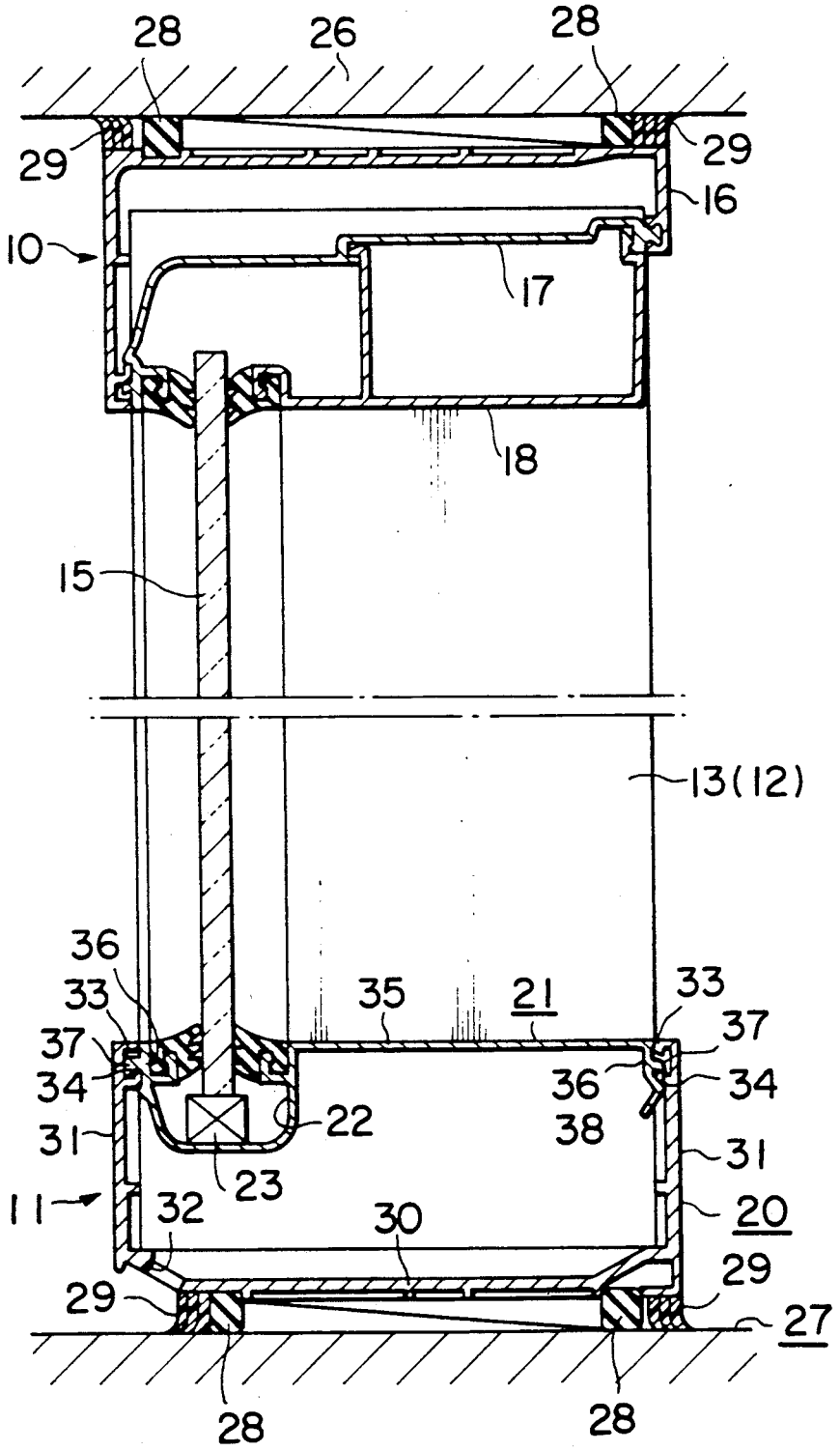
FIGS. 1 and 2 are cross-sectional views taken along lines I—I and II—II, respectively, of FIG. 3, showing a window incorporating a windowsill according to one embodiment of this invention.

The head 10 includes an inverted U-shape head member 16 and a head attachment 17, as shown in FIG. 1. The upper ends of the side and central muntins 12, 13 are received in the head member 16 of the head 10, and the upper end of the panel 15 is supported in the head attachment 17 by a push member 18.

The sill 11 includes a U-shaped sill member 20 and a sill attachment 21. A lower end of the panel 15 is received in a concave portion 22 of the sill attachment 21 via a glass liner 23. Lower ends of the muntins 12, 13 are supported in the sill member 20.

Figure 2:
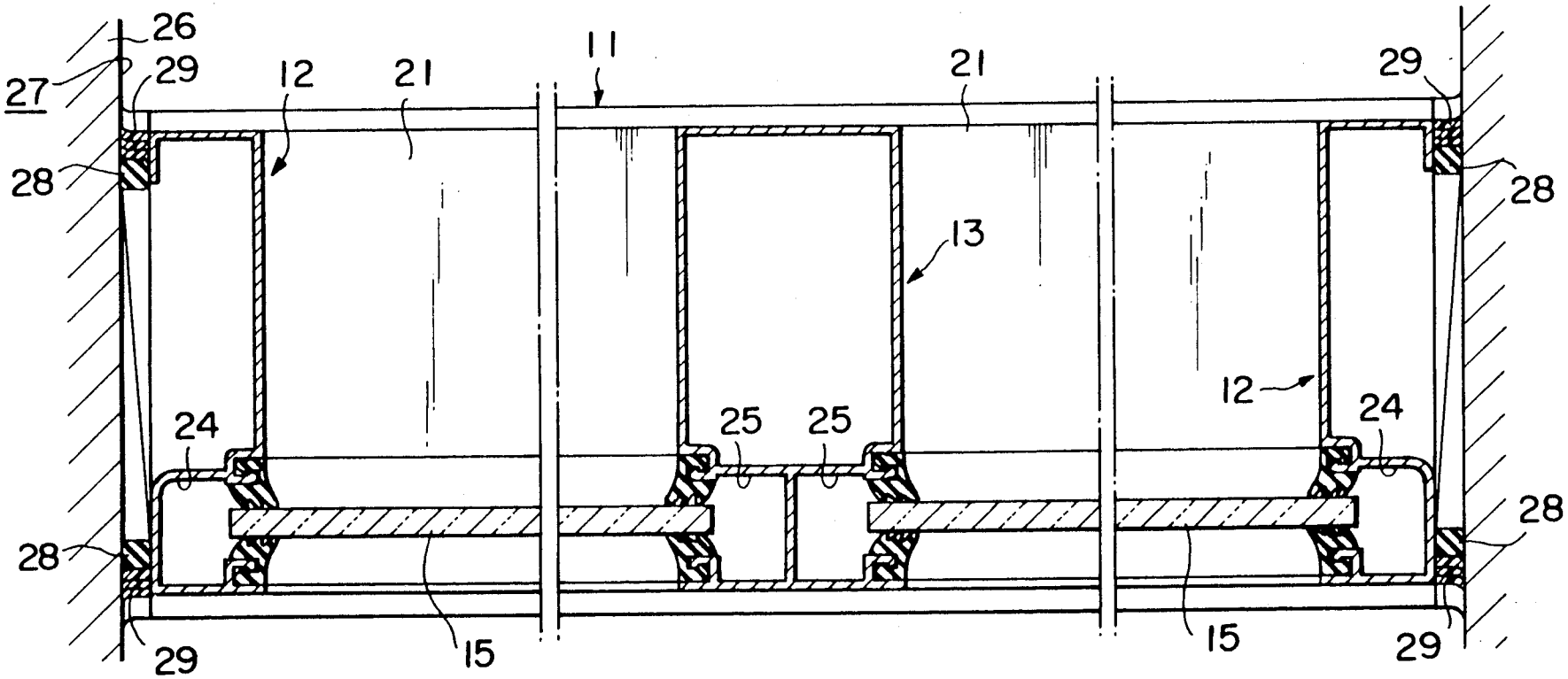

As shown in FIG. 2, each side muntin 12 has a concave portion 24 for receiving the panel, and the central muntin 13 has a pair of concave portions 25 for receiving the panels 15. The head member 16, the sill member 20 and the side muntins 12, 12 are supported within a window opening 27 of a building 26, for example, and are sealed by backup members 28 and caulking materials 29, as shown in FIGS. 1 and 2.

The sill member 20 includes a bottom plate 30 and a pair of vertical plates 31, which are arranged in the shape of U. The bottom plate 30 has an exhaust port 32 on its exterior side. The vertical plates 31, 31 have at their upper ends muntin contacting portions 33 and upward hooks 34 slightly below the muntin contacting portions 33. The sill attachment 21 includes a horizontal plate 35, from opposite ends of which vertical pieces 36 extend. The vertical pieces 36 have downward hooks 37. One of the downward hooks 37 has an arcuate guide piece 38 extending downwardly therefrom.

Figure 4:
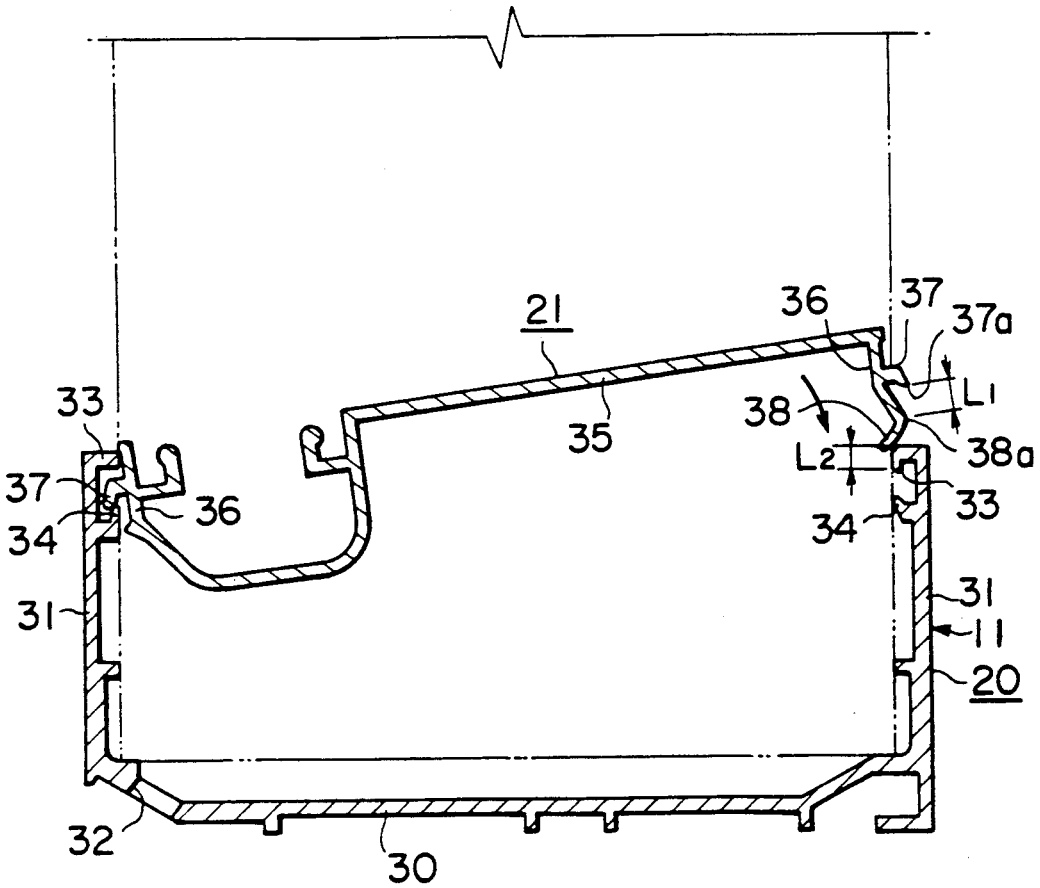
FIG. 4 is an enlarged cross-sectional view of the windowsill of FIGS. 1 and 2.

As shown in FIG. 4, one of the muntin contacting portions 33 is in the shape of downward hook (hereinafter called "the downward hook 37"). The distance $L_1$ between a base 38*a* of the arcuate guide piece 38 and an end 37*a* of the downward hook 37 is slightly shorter than the length $L_2$ of the downward hook 37.

The sill attachment 21 is to be mounted on the sill member 20 as described below.

The sill attachment 21 is held slanting to the horizontal as shown in FIG. 4. One end (hereinafter called "the first end") of the sill attachment 21 is pushed downwardly to cause the downward hook 37 engage with the upward hook 34 of one of the vertical plates 31. By using the engaged portion as a support, the other end (hereinafter called "the second end") of the sill attachment 21 is pushed downwardly to cause the guide piece 38 engage with the downward hook 37.

Figure 5:
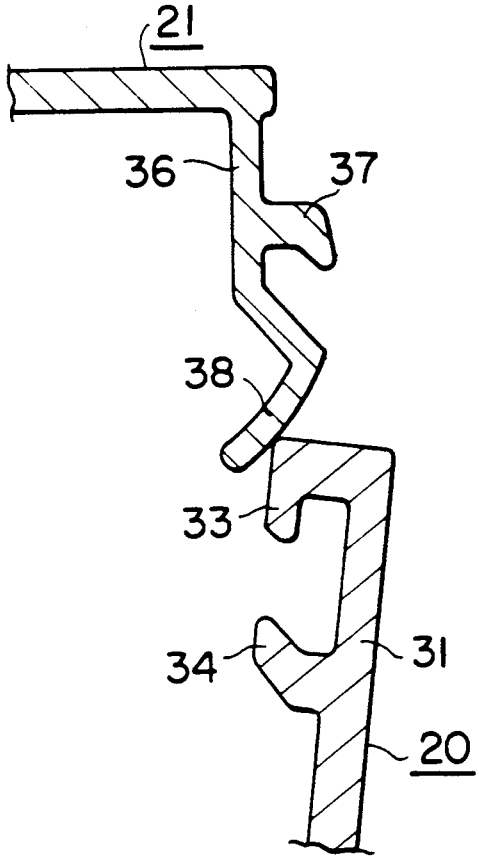
FIGS. 5 through 10 show the manner in which a sill attachment is mounted.
Figure 6:
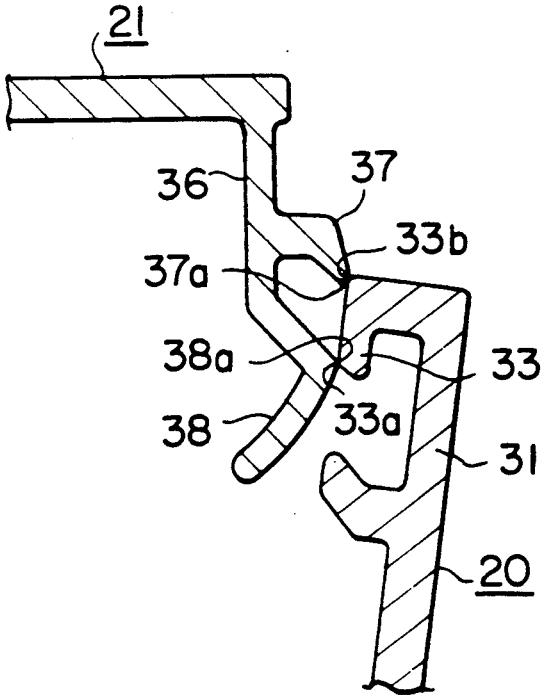

Under this condition, the second end of the sill attachment 21 is further pushed downwardly, thereby moving the guide piece 38 along the downward hook 37, as shown in FIGS. 5 and 6.

The vertical plates 31 of the sill member 20 is to be elastically deformed outwardly.

As shown in FIG. 6, an end 37*a* of the downward hook 37 comes into contact with an upper edge 33*b* of the downward hook 37 before the base 38*a* of the guide piece 38 is removed from a lower edge 33*a* of the downward hook 37, thereby preventing the downward hook 37 from interfering with the upper surface of the downward hook 37.

Figure 7:
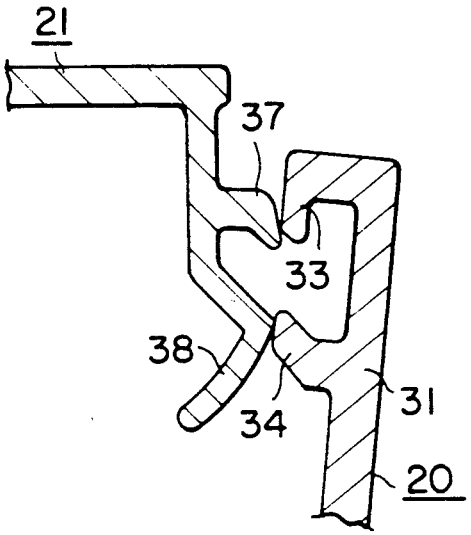

When the second end of the sill attachment 21 is pushed further downwardly, the downward hook 37 slides downwardly along the downward hook 37 as shown in FIG. 7, thereby enabling the vertical plate 31 to be elastically deformed further outwardly.

Figure 8:
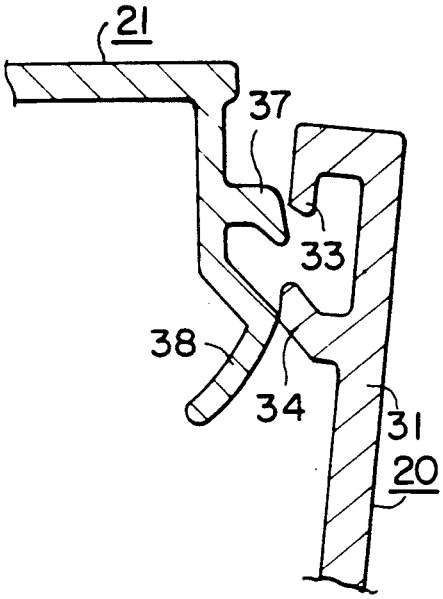
Figure 9:
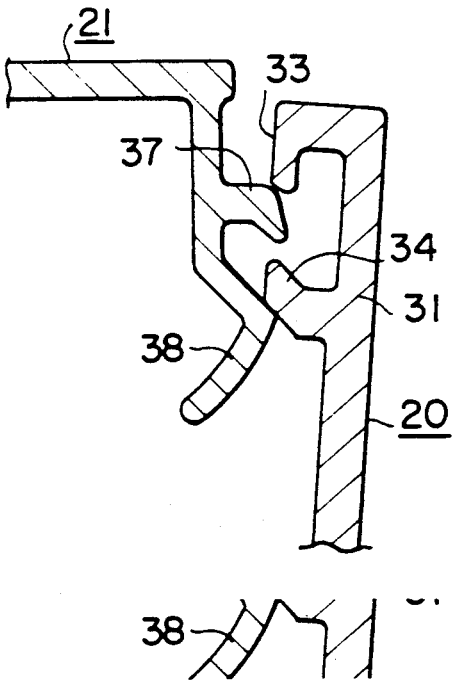
Figure 10:
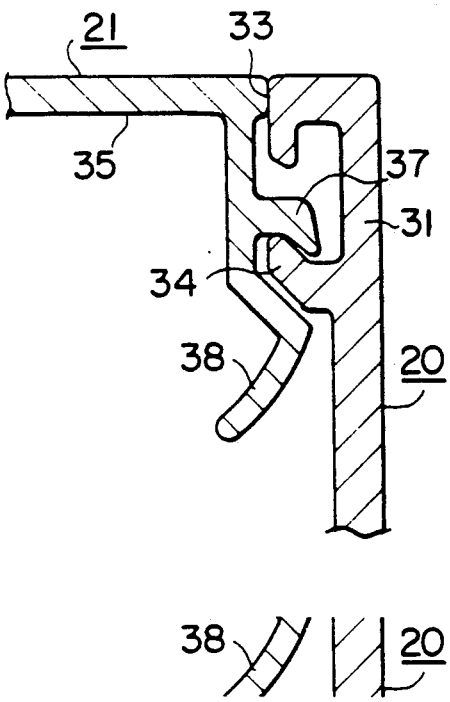

Further downward movement of the second end of the sill attachment 21 brings the downward hook 37 away from the downward hook 37, as shown in FIG. 8. The guide piece 38 comes into contact with the upward hook 34, keeping the vertical plate 31 deformed further outwardly. When the guide piece 38 is brought away from the upward hook 34, as shown in FIG. 9, the vertical plate 31 resiliently restores its original posture. Then the upward hook 34 engages with the downward hook 37, and the downward hook 37 comes into contact with the second end of the horizontal plate 25 of the sill attachment 21, as shown in FIG. 10.

Figure 11:
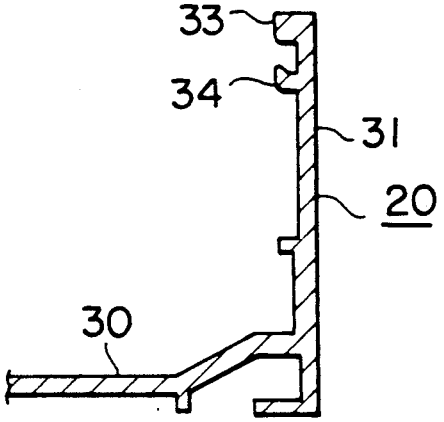
FIG. 11 is a cross-sectional view showing a modified example of the windowsill.
Figure 12:
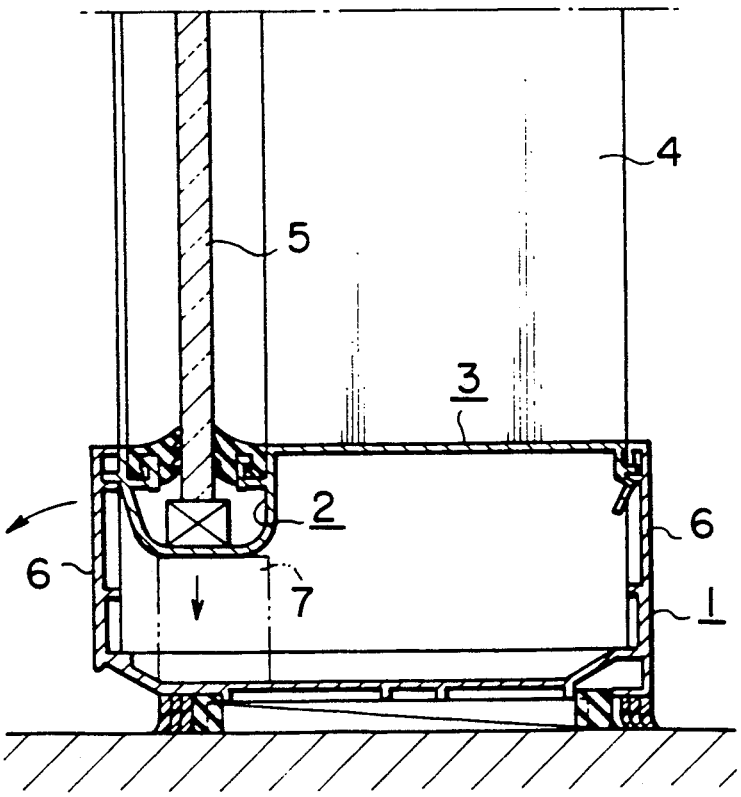
FIG. 12 is a cross-sectional view showing a conventional windowsill.

The downward hook 37 of the vertical plate may be in the shape of a block, as shown in FIG. 11.

According to this invention, when the sill attachment 21 mounted on the sill member 20 is pushed downwardly by the weight of the panel 15, a pair of the vertical plates 31 are pulled inwardly by engagement of the downward hook 37 and upward hook 34, thereby keeping the vertical plates 31, 31 from being deformed outwardly. Therefore, no gaps will be formed between the muntins and the muntin contacting portions 33 (one of which is the downward hook 37), since the muntin contacting portions 33 remain at their normal position. No block will be necessary to bear the weight of the panel 15, thereby facilitating assembling of the windowsill. In addition, no rain water would penetrate into the windowsill.

When the sill attachment 2 is coupled with the sill member 20, the guide piece 38 slides along the downward hook 37, making the vertical plate 31 deformed elastically outwardly. Therefore, the downward hook 37 can engage smoothly with the upward hook 34 without interfering with the upper side of the downward hook 37. The sill attachment 21 can be coupled with the sill member 20 more easily.

What is claimed is:

1. A windowsill comprising:

(a) an inverted U-shaped sill member including a bottom plate and a pair of vertical plates, each said vertical plate having at its upper end a muntin contacting portion and an upward hook vertically aligned with said muntin contacting portion with a spacing; and (b) a sill attachment including a horizontal plate having a concave portion for receiving a window pane, and a pair of vertical pieces extending from opposite ends of said horizontal plate, one of said vertical pieces having a downward hook, the other vertical piece having a downward hook and a guide piece vertically aligned with said downward hook with a spacing, said downward hooks being adapted to engage respectively with said upward hooks of said vertical plates of said sill member so that the opposite ends of said horizontal plate come into contact with said muntin contacting portions of said vertical plates to couple with said sill member and said sill attachment.

* * * * *